US007372410B2

(12) United States Patent
Hori

(10) Patent No.: US 7,372,410 B2
(45) Date of Patent: May 13, 2008

(54) ANTENNA UNIT

(75) Inventor: Fusao Hori, Izu (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 74 days.

(21) Appl. No.: 11/362,889

(22) Filed: Feb. 27, 2006

(65) Prior Publication Data

US 2006/0208948 A1 Sep. 21, 2006

(30) Foreign Application Priority Data

Mar. 16, 2005 (JP) ..... 2005-075304

(51) Int. Cl.
*H01Q 1/38* (2006.01)

(52) U.S. Cl. ..... 343/700 MS; 343/846

(58) Field of Classification Search ..... 343/700 MS, 343/846
See application file for complete search history.

(56) References Cited

U.S. PATENT DOCUMENTS 6,239,751 B1 * 5/2001 McRae et al. ..... 343/700 MS

FOREIGN PATENT DOCUMENTS

JP 10-233617 2/1998

* cited by examiner

*Primary Examiner*—Michael C. Wimer
(74) *Attorney, Agent, or Firm*—Pearne & Gordon LLP

(57) ABSTRACT

An antenna unit according to an embodiment of the invention includes an antenna that communicates with a RFID and a frequency switch that switches a frequency of a radio wave that the antenna transmits and receives, wherein the antenna includes a radiation plate that radiates a radio wave that communicates with the RFID, a ground plate that is disposed with a predetermined distance separated from the radiation plate and a distance switch that varies a distance between the ground plate and the radiation plate.

9 Claims, 2 Drawing Sheets

ANTENNA UNIT

CROSS-REFERENCE TO THE INVENTION

The application is based upon and claims the benefit of priority from the prior Japanese Patent Application No. 2005-075304, filed on Mar. 16, 2005; the entire contents of which are incorporated herein by reference.

BACKGROUND OF THE INVENTION

1. Field of the Invention

The invention relates to an antenna unit that is used to communicate with a wireless tag (RFID: Radio Frequency Identification).

2. Description of the Related Art

Recently, a system that communicates with an article provided with a RFID to read and write information of the article is gathering attention. In such a system, an antenna is used to transmit and receive a signal to and from the RFID. It is preferable that impedance matching is established between the antenna and an electric supply line. However, in actuality, from various reasons, the impedance mismatch is caused. Owing to the mismatch, an amount of reflected waves increases to weaken radio waves irradiated into a space.

From a viewpoint of the antenna efficiency, the reflected waves are desirably as small as possible. Accordingly, the antenna is used with the return loss (reflection loss) caused by the reflected waves made small. However, the return loss varies depending on an operating frequency that is used to communicate with the RFID. That is, while the return loss is small at a certain frequency, when the operating frequency is changed to other frequency, the return loss becomes larger to deteriorate the efficiency.

SUMMARY OF THE INVENTION

The invention was carried out in view of the above-mentioned situations of an existing antenna, and intends to provide an antenna unit that even when an operating frequency is changed the return loss can be suppressed low and can maintain the antenna efficiency high.

An antenna unit according to an aspect according to the invention includes an antenna that communicates with a RFID and a frequency switch that switches a frequency of a radio wave that the antenna transmits and receives. The antenna includes a radiation plate that radiates a radio wave that communicates with the RFID, a ground plate that is disposed separated by a predetermined distance from the radiation plate and a distance switch that varies a distance between the ground plate and the radiation plate.

According to the aspect of the invention, an antenna unit that even when an operating frequency is changed the return loss can be suppressed low and can maintain the antenna efficiency high can be obtained.

DETAILED DESCRIPTION OF THE INVENTION

In what follows, as an antenna unit that communicates with a RFID, an embodiment of the invention where for instance a patch antenna is used will be described with reference to the drawings.

Figure 1:
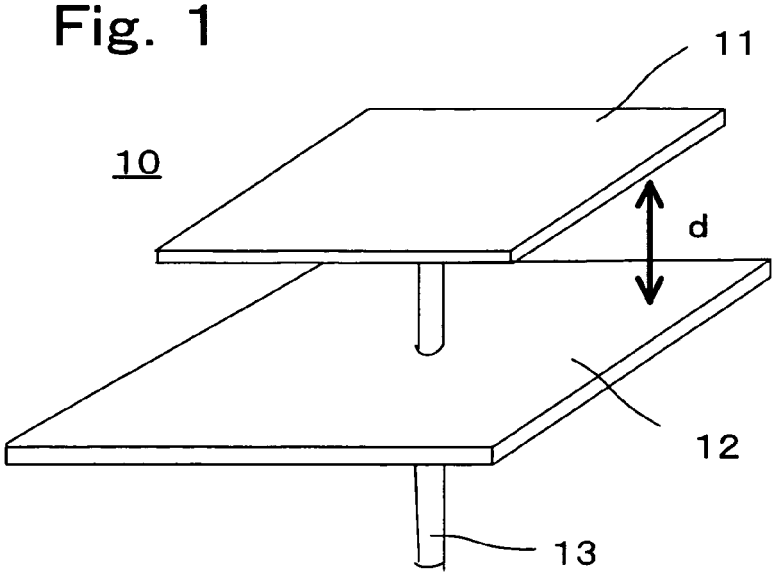
FIG. 1 is a schematic diagram for explaining an example of a structure of an antenna unit according to an embodiment of the invention.

In FIG. 1, a structure of a patch antenna according to the embodiment is shown. The patch antenna 10 includes a radiation plate 11 that radiates a radio wave, a ground plate 12 that is disposed separated by a predetermined distance from the radiation plate 11 and grounded, a support bar 13 that supports the ground plate 12 and the radiation plate 11 separated with a predetermined distance, and an interplanar distance switch unit (not shown) that switches a distance between the ground plate 12 and the radiation plate 11. A distance d between the radiation plate 11 and the ground plate 12 can be switched with the interplanar distance switch unit. That is, between the radiation plate 11 and the ground plate 12, an air layer is disposed.

Figure 2:
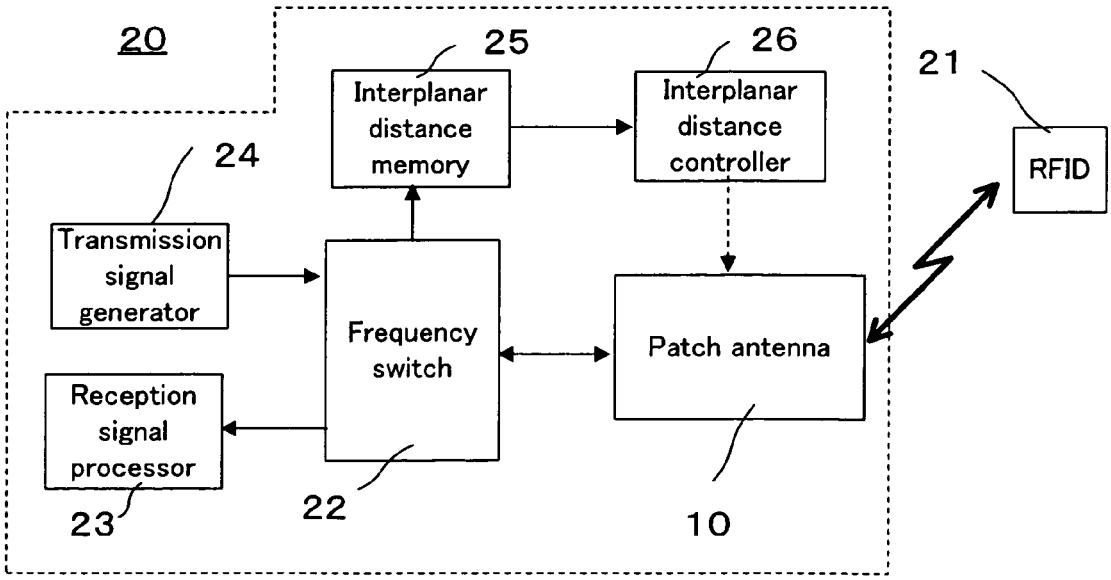
FIG. 2 is a diagram showing an example of an electric configuration of an antenna unit according to an embodiment of the invention.

In FIG. 2, an example of an electrical configuration of the embodiment according to the invention is shown. An information reader 20 of the RFID includes a patch antenna 10 that communicates with a RFID 21, a frequency switch 22 that switches a frequency that the patch antenna 10 transmits or receives, a reception signal processor 23 that processes a signal from the RFID 21 with a signal received by the patch antenna 10, a transmission signal generator 24 that generates a signal that is transmitted from the patch antenna 10, an interplanar distance memory 25 that in accordance with a frequency of a signal received by or transmitted from the patch antenna 10, in advance, memories the interplanar distance d, and an interplanar distance controller 26 that, according to the output, controls an interplanar distance of the patch antenna 10. The interplanar distance controller 26 controls the interplanar distance switch to set the radiation plate 11 and the ground plate 12 at a predetermined separation (distance).

Figure 3:
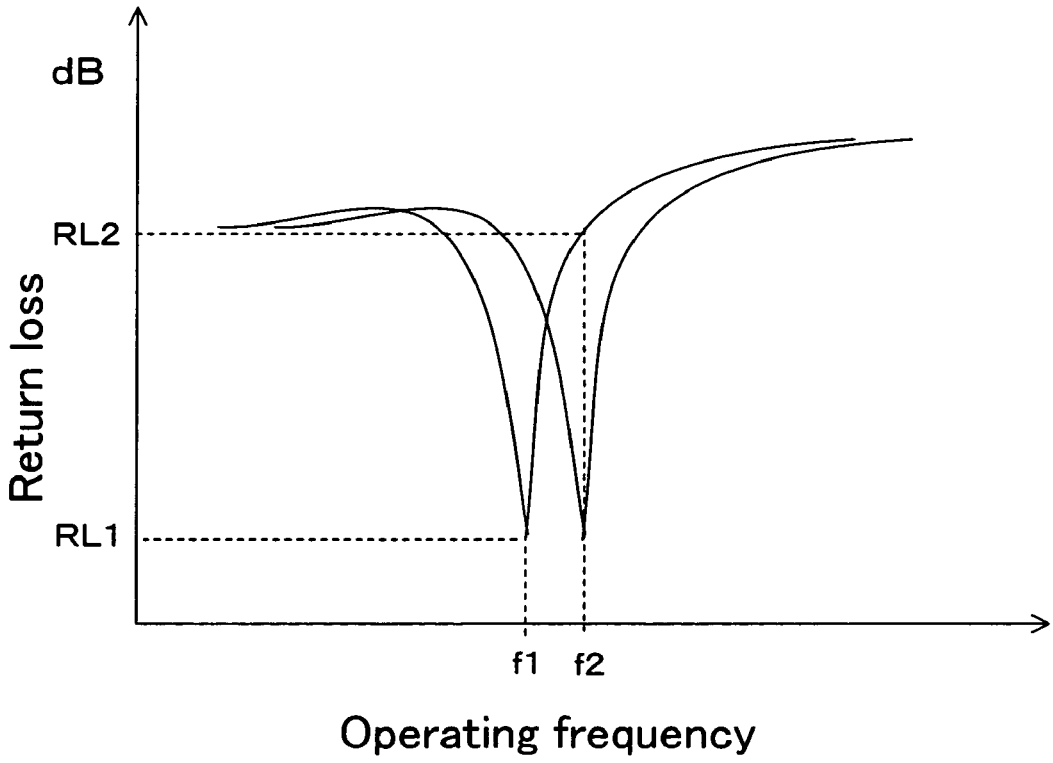
FIG. 3 is a characteristic diagram for explaining an operation of an embodiment of the invention.

An optimum distance d between the radiation plate 11 and the ground plate 12 of the patch antenna 10 is different depending on frequencies at which communication with the RFID 21 is performed. FIG. 3 shows an example of the return loss characteristics with respect to the frequency. In FIG. 3, a horizontal axis shows a frequency at which communication with the RFID is performed and a vertical axis shows the return loss (dB) at that time.

When a communication frequency with the RFID 21 is for instance f1, the return loss becomes most small such as RL1 and the antenna becomes most efficient. At that time, a distance between the radiation plate 11 and the ground plate 12 is taken as d1. When, with the interplanar distance of the patch antenna 10 maintained as it is, communication is carried out at a frequency of f2, the return loss becomes RL2, that is, increases. In this connection, when the communication frequency is being set at f2, the distance between the radiation plate 11 and the ground plate 12 of the patch antenna 10 is determined so that the return loss may be smallest in accordance with the frequency. A distance d between the radiation plate 11 and the ground plate 12, where the return loss becomes smallest with respect to the communication frequency, is calculated or measured in advance and memorized in an interplanar distance memory 25 made of for instance a memory.

In the above-mentioned embodiment, only an air layer is disposed between the radiation plate 11 and the ground plate 12. However, a dielectric layer high in the dielectric constant may be partially disposed therebetween. When such a structure is adopted, an electric length between the radiation plate 11 and the ground plate 12 can be advantageously lengthened.

According to the embodiment of the invention, when, in accordance with the communication frequency with the RFID of the patch antenna, a distance between the radiation plate 11 and the ground plate 12 is altered to a predetermined value, the return loss can be made smaller and thereby the radiation efficiency of the antenna can be advantageously heightened.

In the embodiment, a case where a patch antenna is used to communicate with the RFID is explained. However, the antenna that is used in the invention is not restricted to this kind of antenna. When other kinds of antennas capable of altering the characteristics by altering a separation between the radiation plate and the ground plate are used as well, the invention can be applied.

What is claimed is:

1. An antenna unit, comprising:

a patch antenna that communicates with a RFID; and a frequency switch that switches a frequency of a radio wave that the patch antenna transmits and receives, wherein the patch antenna includes a radiation plate that radiates a radio wave that communicates with the RFID, a ground plate that is disposed with a predetermined distance separated from the radiation plate by one support bar that supports the ground plate and the radiation plate at substantially a center respectively and a distance switch that varies a distance between the ground plate and the radiation plate.

2. The antenna unit according to claim 1, wherein the distance switch varies a distance between the ground plate and the radiation plate so that in accordance with a frequency at which the antenna communicates with the RFID the return loss becomes small.

3. The antenna unit according to claim 2, wherein only an air layer is disposed between the radiation plate and the ground plate.

4. The antenna unit according to claim 2, wherein a dielectric layer is disposed in a part of the area between the radiation plate and the ground plate.

5. An antenna unit, comprising:

an antenna including a radiation plate that radiates a radio wave that communicates with a RFID, a ground plate that is disposed with a predetermined distance separated from the radiation plate and a distance switch that varies a distance between the ground plate and the radiation plate;

an interplanar distance memory that memorizes a distance between the radiation plate and the ground plate, where the return loss of the antenna becomes smallest in accordance with a frequency at which communication with the RFID is carried out; and an interplanar distance controller that reads a distance corresponding to a communication frequency when the antenna communicates with the RFID from the interplanar distance memory to control the interplanar distance controller.

6. The antenna unit according to claim 5, wherein the antenna is a patch antenna.

7. The antenna unit according to claim 6, wherein the radiation plate and the ground plate are supported and separated with a bar-like member.

8. The antenna unit according to claim 7, wherein only an air layer is disposed between the radiation plate and the ground plate.

9. The antenna unit according to claim 8, wherein a dielectric layer is disposed in a part of the area between the radiation plate and the ground plate.

* * * * *